US011175066B2

(12) United States Patent
Balakrishna et al.

(10) Patent No.: US 11,175,066 B2
(45) **Date of Patent: *Nov. 16, 2021**

(54) METHOD AND SYSTEM FOR REDUCING MOISTURE CARRYOVER IN AIR HANDLERS

(71) Applicant: TRANE INTERNATIONAL INC., Davidson, NC (US)

(72) Inventors: Abhijith Balakrishna, Bangalore (IN); Brian John Newton, West Salem, WI (US)

(73) Assignee: TRANE INTERNATIONAL INC., Davdson, NC (US)

( * ) Notice: Subject to any disclaimer, the term of this patent is extended or adjusted under 35 U.S.C. 154(b) by 71 days.

This patent is subject to a terminal disclaimer.

(21) Appl. No.: 16/686,508

(22) Filed: Nov. 18, 2019

(65) Prior Publication Data

US 2020/0096222 A1 Mar. 26, 2020

Related U.S. Application Data

(63) Continuation of application No. 15/673,698, filed on Aug. 10, 2017, now Pat. No. 10,480,816.

(51) Int. Cl.
*F24F 13/08* (2006.01)
*F24F 13/22* (2006.01)

(52) U.S. Cl.
CPC ..... *F24F 13/08* (2013.01); *F24F 13/22* (2013.01); *F24F 13/222* (2013.01)

(58) Field of Classification Search
CPC ..... F24F 13/08; F24F 13/22; F24F 13/222
See application file for complete search history.

(56) References Cited

U.S. PATENT DOCUMENTS

| | | | | |
|---|---|---|---|---|
| 3,006,436 | A | 10/1961 | Starbuck et al. | |
| 3,864,110 | A | 2/1975 | Wyman et al. | |
| 4,072,478 | A | 2/1978 | Regehr et al. | |
| 4,103,508 | A | 8/1978 | Apple | |
| 4,616,777 | A | 10/1986 | Fisher et al. | |
| 4,784,674 | A | 11/1988 | Sarmiento et al. | |
| 4,987,748 | A * | 1/1991 | Meckler | F24F 3/14 62/176.1 |
| 5,531,801 | A | 7/1996 | Sewell et al. | |
| 5,564,287 | A | 10/1996 | Hearne et al. | |
| 6,432,367 | B1 | 8/2002 | Munk | |
| 7,445,200 | B2 | 11/2008 | Lee et al. | |
| 10,480,816 | B2 * | 11/2019 | Balakrishna | F24F 13/08 |
| 2009/0038328 | A1 * | 2/2009 | Piccione | F24F 13/222 62/291 |
| 2009/0239463 | A1 * | 9/2009 | Goenka | F24F 13/04 454/331 |
| 2012/0024977 | A1 * | 2/2012 | Buttridge | B01F 3/04496 239/8 |

* cited by examiner

*Primary Examiner* — Emmanuel E Duke
(74) *Attorney, Agent, or Firm* — Hamre, Schumann, Mueller & Larson, P.C.

(57) ABSTRACT

A heating, ventilation, air conditioning and refrigeration system includes a diffuser comprising a plurality of diffuser elements located between a blower driving airflow through the system and a refrigeration coil used to cool the airflow prior to the distribution of the airflow to a building. Locating diffusers between the blower and the refrigeration coil reduces the extent to which the airflow carries moisture from condensate on the refrigeration coil, and can prevent circulation of air backwards through the refrigeration coil.

20 Claims, 13 Drawing Sheets

METHOD AND SYSTEM FOR REDUCING MOISTURE CARRYOVER IN AIR HANDLERS

FIELD

This disclosure relates to heating, ventilation, air conditioning and refrigeration (HVACR) units, particularly to air handling units and their surrounding structures.

BACKGROUND

Air handlers in HVACR units output a high-velocity airflow. This high-velocity airflow may pass through a refrigerant coil, on which there may be a condensate. The velocity of the airflow may blow the condensate off the coil and carry the condensate into a building cooled by the HVACR system or to points within the HVACR system where water can accumulate, causing corrosion and/or contamination of conditioned air. The airflow from the blower through the refrigerant coil may also result in vortices away from the core of the airflow, which may cause some of the airflow to also circulate backwards through the blower and reduce system efficiency. The condensate carried by the airflow may require installation of a drain pan within the HVACR unit, adding cost and increasing unit size.

BRIEF SUMMARY

A diffuser comprising a plurality of diffuser elements is disposed between the outlet of a blower and a refrigeration coil in an air handling unit for an HVACR system. The diffuser elements are arranged and/or configured to deflect the airflow, spreading it over more of the refrigeration coil and reducing the velocity of air passing through any particular point in the refrigeration coil, reducing moisture carryover resulting from high-velocity air traveling through the refrigeration coil on which there may be condensate. This enables a reduction in the size of drain pans, and a reduction in air handler length, reducing cost, and reduces moisture carryover.

An HVACR system embodiment includes a blower, a refrigeration coil, and a diffuser including a plurality of diffuser elements. The diffuser elements may be, for example, cylindrical, semi-cylindrical, generally planar, and/or angled such as an L-shaped bracket. The diffuser elements may be perforated. The diffuser elements may be arranged into staggered rows, a grid of rows and columns, or patterns such as a chevron pattern.

A method embodiment includes driving an airflow through use of a blower, directing the airflow to a diffuser including a plurality of diffuser elements, and cooling the airflow after it exists the diffuser, using a refrigeration coil. The airflow may then be directed into a building to be cooled. The airflow may travel through the refrigeration coil in only one direction. The diffuser elements may be, for example, cylindrical, semi-cylindrical, generally planar, and/or angled such as an L-shaped bracket. The diffuser elements may be perforated. The diffuser elements may be arranged into staggered rows, a grid of rows and columns, or other patterns such as a chevron pattern.

DETAILED DESCRIPTION

A plurality of diffuser elements are located between a blower and a refrigerant coil in an air handling unit of a heating, ventilation, air conditioning and refrigeration (HVACR) unit. The diffuser elements are arranged and/or configured to deflect an airflow from a blower to slow the airflow and spread the airflow more evenly over the refrigerant coil. The diffusers may distribute the airflow to over 90% of the surface area of a refrigerant coil. This reduces moisture carryover produced by the airflow from the blower as it passes through the refrigerant coil. This may permit shortening of drain pans in the air handling unit and/or reduction of air handling unit size.

Figure 1A:
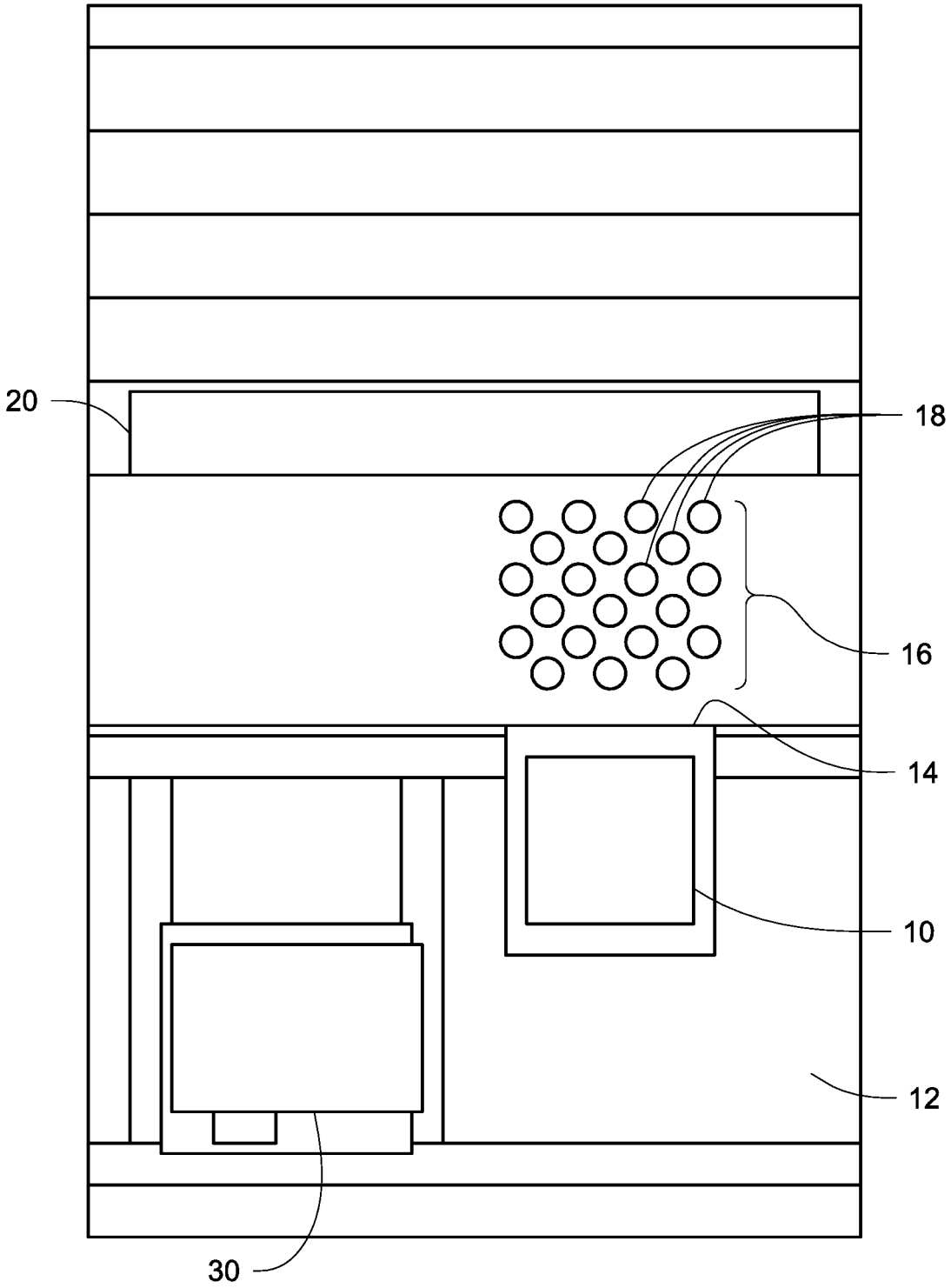
FIG. 1A shows a schematic of an HVACR air handling unit embodiment from a top-down view.

FIG. 1A shows a schematic of an embodiment of an HVACR air handling unit from a top-down view. Blower 10 draws in air from within inlet chamber 12, and expels an airflow through outlet 14. A diffuser 16 is located between the outlet 14 of blower 10 and the refrigeration coil 20. The diffuser 16 is made up of a plurality of diffuser elements 18.

Blower 10 is a blower capable of expelling an airflow through an outlet 14. Blower 10 may be, for example, a housed centrifugal blower, a centrifugal blower, or an axial fan. In the embodiments shown in FIGS. 1A-5C, blower 10 is a housed centrifugal blower. Blower 10 may draw in air from within inlet chamber 12 and expel the air through outlet 14. In the embodiment shown in FIGS. 1A and 1B, the blower brings air in axially through an inlet, and drives an airflow through an outlet of the blower. Blower 10 may create a continuous airflow. The amount of airflow expelled by blower 10, for example expressed as a volume over time, may be based on the HVACR needs of a building, for example a cooling load for the building. The outlet 14 of blower 10 directs the airflow towards diffuser 16 and refrigeration coil 20. In an embodiment, the blower 10 may be driven by external motor 30.

Refrigeration coil 20 may be a heat exchanger. The refrigeration coil 20 cools airflow traveling through it. In an embodiment, refrigeration coil 20 receives a compressed refrigerant, which is expanded by heat transferred to the refrigeration coil by an airflow. Condensate may form on parts of the refrigeration coil, for example due to the temperature of the coil and humidity of the airflow passing through the coil. Refrigeration coil 20 may cover substantially the entire width and height of the air handling unit. In an embodiment, the width and height of the refrigeration coil are larger than the size of outlet 14 of blower 10.

Diffuser 16 is located between outlet 14 of blower 10 and the refrigeration coil 20. The diffuser 16 is made up of multiple diffuser elements 18. The diffuser elements 18 of the embodiment shown in FIG. 1A are cylindrical. The diffuser elements may, for example, be oriented to run vertically between a bottom wall and a top wall of a chamber between the outlet 14 of blower 10 and the refrigerant coil 20. The diffuser elements 18 may be made of a rigid material, such as a polymer or a metal such as aluminum or steel. The material used for diffuser elements 18 may be based on stability and rigidity needs for the air handling unit, for example to reduce or eliminate vibration of diffuser elements 18 at the airflow velocities within the air handling unit. The diffuser elements 18 may be hollow or solid. Whether the diffuser elements are hollow or solid may be based on may be based on stability and rigidity needs for the air handling unit, for example to reduce or eliminate vibration of diffuser elements 18 at the airflow velocities within the air handling unit and the material selected for the diffuser elements 18.

In the embodiment shown in FIG. 1A, the diffuser elements 18 are arranged in six rows when viewed from the top-down perspective, with three rows of four diffuser elements 18 and three rows of three diffuser elements 18. The rows may be staggered such that from the perspective of the outlet 14 of the blower, the diffuser elements 18 of one row are located in the horizontal gaps between individual diffuser elements 18 in at least one other row of diffuser elements. The rows alternate between rows of three diffuser elements 18 and rows of four diffuser elements 18, with a row of three diffuser elements 18 closest to the outlet 14 of blower 10. The diffuser elements 18 may be arranged so that from a top-down perspective, the diffuser elements are centered with respect to outlet 14 of blower 10.

Figure 1B:
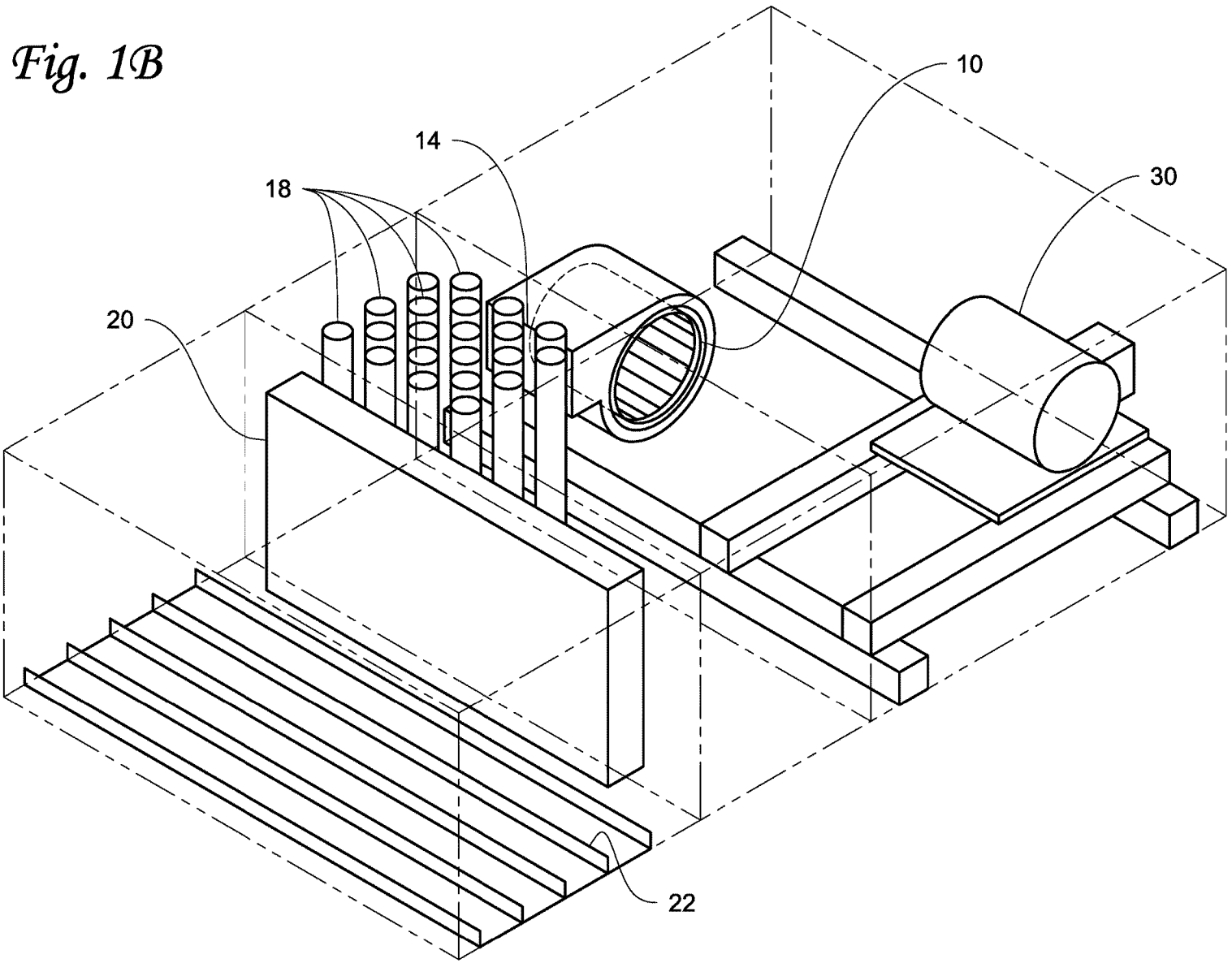
FIG. 1B shows a schematic of the HVACR air handling unit embodiment of FIG. 1A from an isometric view.

FIG. 1B shows a schematic of the embodiment of FIG. 1A from an isometric view. As shown in this view, the outlet 14 of blower 10 may have a height that is less than the height of the refrigeration coil 20. Blower 10 may be located such that the vertical position of the outlet 14 is such that there is space between the top of the outlet 14 and the ceiling of the air handling unit, and also space between the bottom of outlet 14 and a floor of the air handling unit. The diffuser elements 18 may extend from a floor of the air handling unit to a ceiling of the air handling unit. The shape of diffuser elements 18 and their distribution may be based on aerodynamics, particularly distribution of airflow from the outlet 14 of the blower 10. The shape of diffuser elements 18 may also be based on structural stability. The diffuser elements 18 may be fixed to each of the floor and ceiling of the air handling unit. The diffuser elements 18 may be fixed by, for example, welding, bolting, or other attachment. The fixation of the diffuser elements 18 to the floor and ceiling of the air handling unit may provide the diffuser elements with stability and rigidity. Drain pans 22 allow moisture carried off of the refrigeration coil 20 by the airflow to be captured and routed away from the rest of the HVACR system such as a supply outlet of the air handling unit. The length of drain pans 22 may be determined by a distance of moisture carryover within the air handling unit resulting from an airflow passing through refrigerant coil 20. The length of the drain pans 22 may contribute to the overall length of the air handling unit.

Figure 2A:
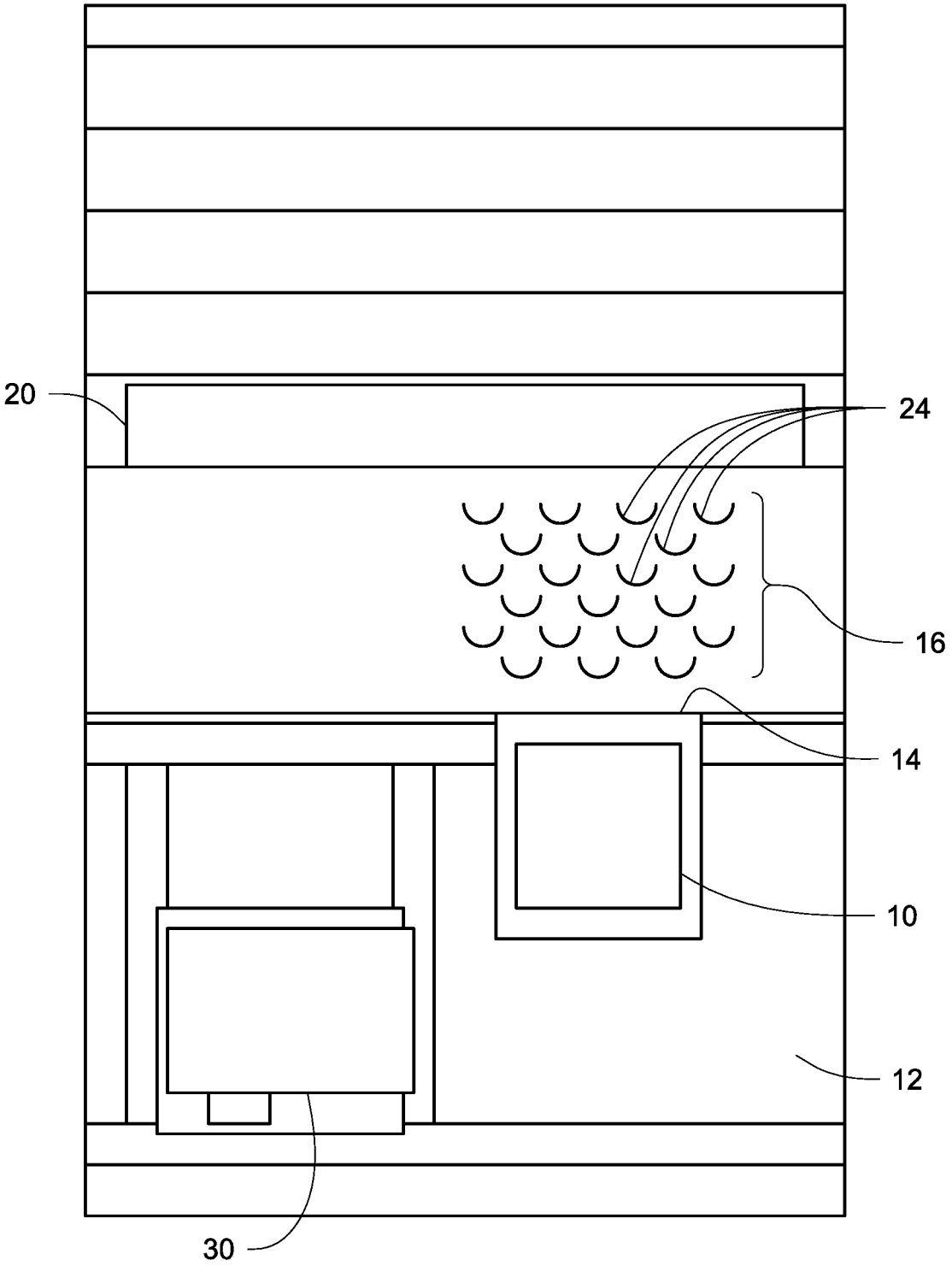
FIG. 2A shows a schematic of an HVACR air handling unit embodiment from a top-down view.

FIG. 2A shows a schematic of an embodiment from a top-down view. In the embodiment shown in FIG. 2A, the diffuser elements 24 which are included in the diffuser 16 are semi-circular in shape. The semi-circular diffuser elements 24 may be arranged such that the concave side of the diffuser elements 24 faces away from the outlet 14 of the blower 10. The semi-circular diffuser elements 24 may be arranged in a staggered pattern, for example with six staggered rows when viewed from the top-down perspective, with three rows of four diffuser elements 24 alternating with three rows of three diffuser elements 24. A row of three diffuser elements 24 may be closest to the outlet 14 of blower 10. The semi-circular diffuser elements 24 may be perforated.

Figure 2B:
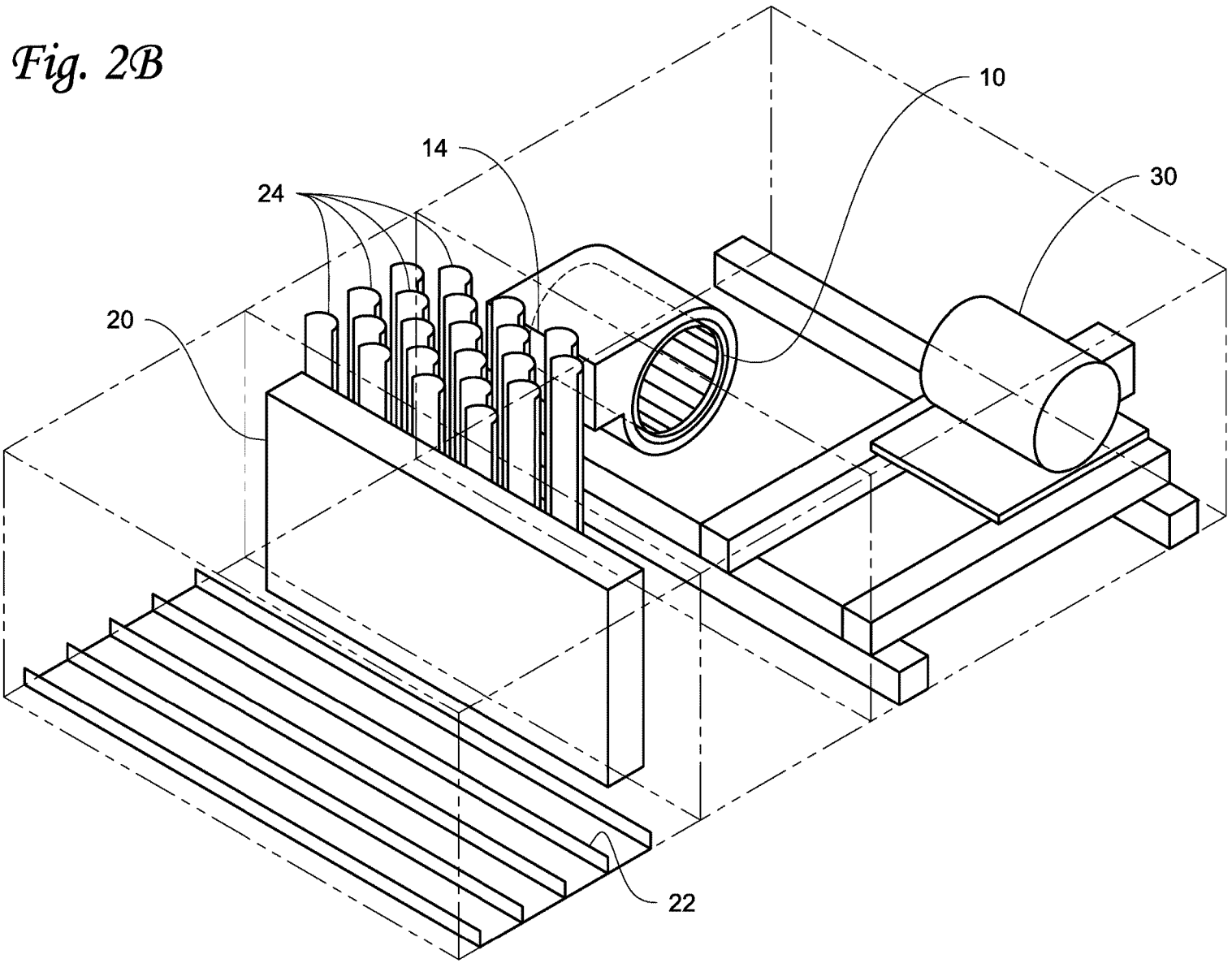
FIG. 2B shows a schematic of the HVACR air handling unit embodiment of FIG. 2A from an isometric view.

FIG. 2B shows a schematic of the embodiment of FIG. 2A from an isometric view. As seen in this view, the diffuser elements 24 may extend from a floor of the air handling unit to a ceiling of the air handling unit. The diffuser elements 24 may be fixed to each of the floor and ceiling of the air handling unit. Drain pans 22 allow moisture carried off of the refrigeration coil 20 by the airflow to be captured and routed away from the rest of the HVACR system such as a supply outlet of the air handling unit.

Figure 3A:
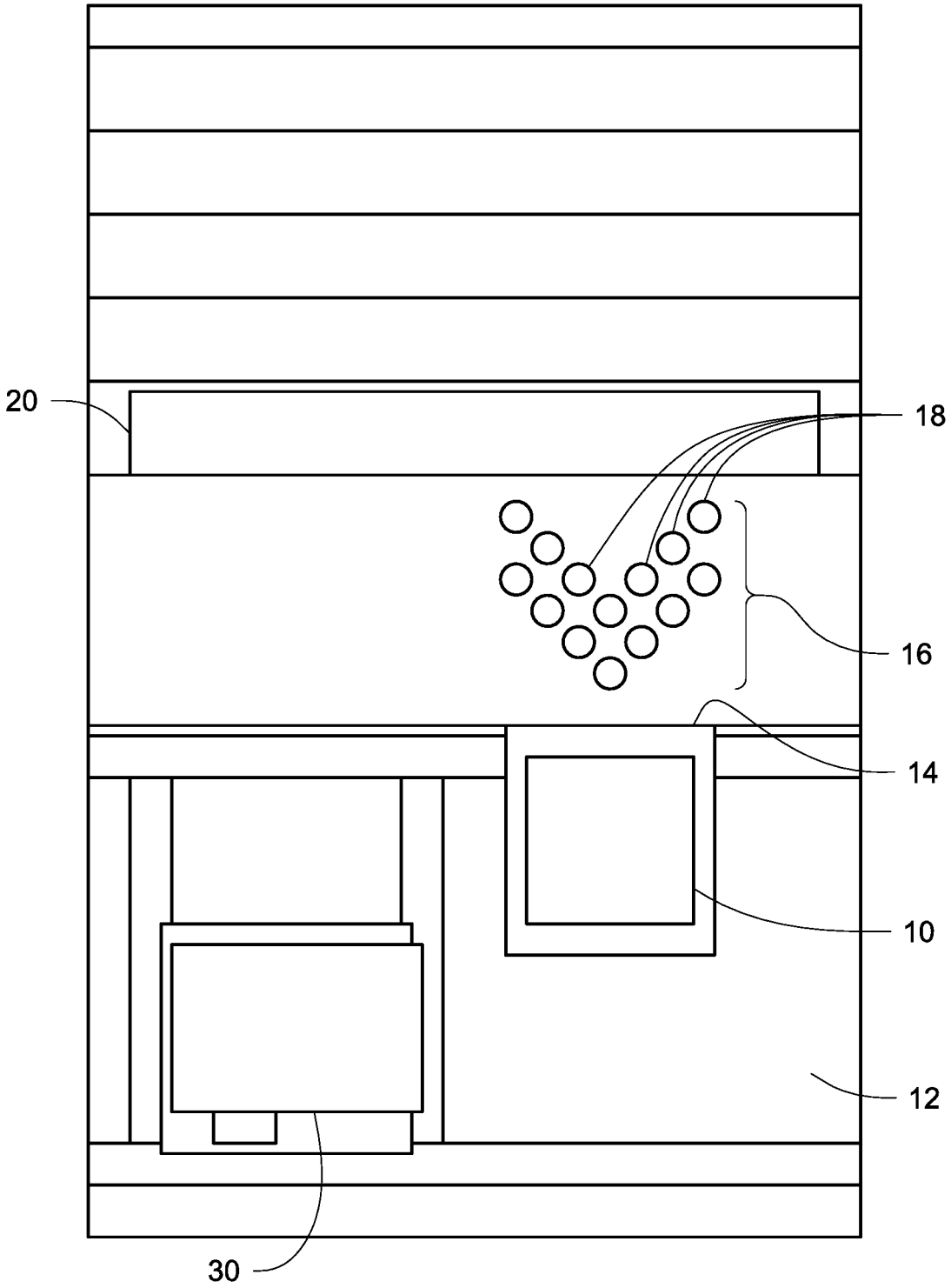
FIG. 3A shows a schematic of an HVACR air handling unit embodiment from a top-down view.

FIG. 3A shows a schematic of an embodiment from a top-down view. In the embodiment shown in FIG. 3A, cylindrical diffuser elements 18 such as those shown in FIGS. 1A and 1B are used. In the embodiment shown in FIG. 3A, the cylindrical diffuser elements 18 are arranged in a chevron pattern when viewed from the top-down or bottom-up to form the diffuser 16. In an embodiment, two or more diffuser elements 18 may be in line with one another with respect to the airflow exiting outlet 14 of blower 10. In the embodiment shown in FIG. 3A, the peak of the chevron faces the outlet 14 of the blower 10. In an embodiment, the peak of the chevron is centered with respect to the outlet 14 of the blower 10. The positioning and orientation of the chevron may be based on the distribution of the airflow from outlet 14 of the blower 10.

Figure 3B:
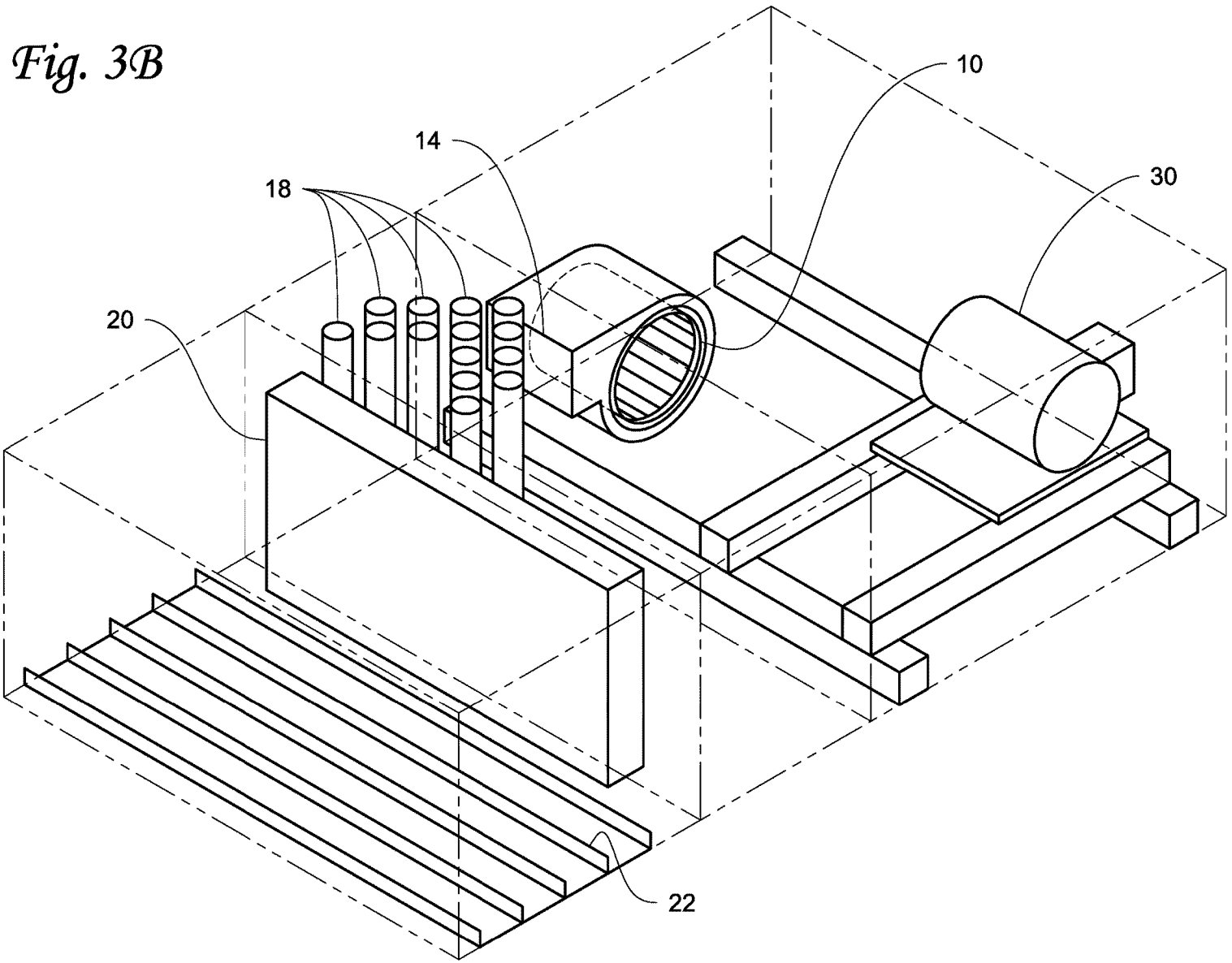
FIG. 3B shows a schematic of the HVACR air handling unit embodiment of FIG. 3A from an isometric view.

FIG. 3B shows a schematic of the embodiment of FIG. 3A from an isometric view. The diffuser elements 18 may extend from a floor of the air handling unit to a ceiling of the air handling unit. The diffuser elements 18 may be fixed to each of the floor and ceiling of the air handling unit. Drain pans 22 allow moisture carried off of the refrigeration coil 20 by the airflow to be captured and routed away from the rest of the HVACR system such as a supply outlet of the air handling unit.

Figure 4A:
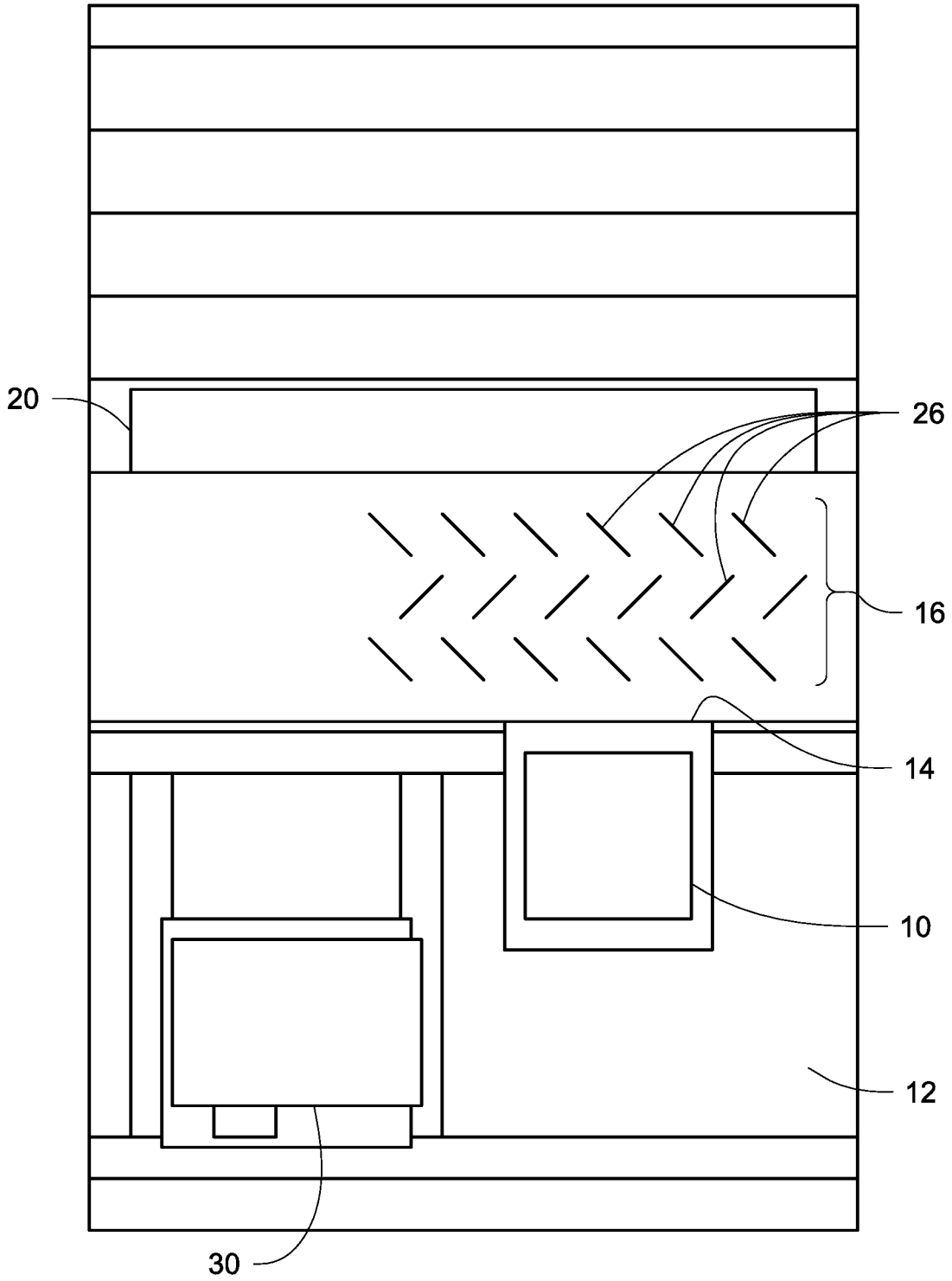
FIG. 4A shows a schematic of an HVACR air handling unit embodiment from a top-down view.

FIG. 4A shows a schematic of an embodiment from a top-down view. In the embodiment shown in FIG. 4A, the diffuser elements 26 are generally planar plates. In an embodiment, the planar diffuser elements 26 are perforated, with one or more holes through each of the planar diffuser elements 26. The size and/or shape of the perforations may be based on the effects of the diffuser on the velocity, volume, and/or pressure of airflow through the air handling unit and the velocity, volume, and/or pressure required to meet the HVACR needs of a structure receiving conditioned air. The planar diffuser elements 26 may be placed at an angle between parallel and perpendicular to the airflow leaving the outlet 14 of the blower 10. In an embodiment, the planar diffuser elements 26 are at an angle selected based on the flow distribution resulting from that angle of the planar diffuser elements 26. The angle may be selected so that it is in a range which is neither too obtuse nor too acute to allow effective flow distribution. In an embodiment, the diffuser elements are at or about a 45 degree angle relative to the airflow leaving outlet 14 of blower 10. The planar diffuser elements 26 may be arranged in a staggered pattern of multiple rows, such that from the perspective of the outlet 14 of the blower, the diffuser elements 26 of one row are located in the horizontal gaps between individual diffuser elements 26 in at least one other row of diffuser elements. In an embodiment, the angle between the diffuser elements and the airflow leaving outlet 14 of blower 10 may alternate with each row. In an embodiment, there may be three rows of planar diffuser elements 26.

Figure 4B:
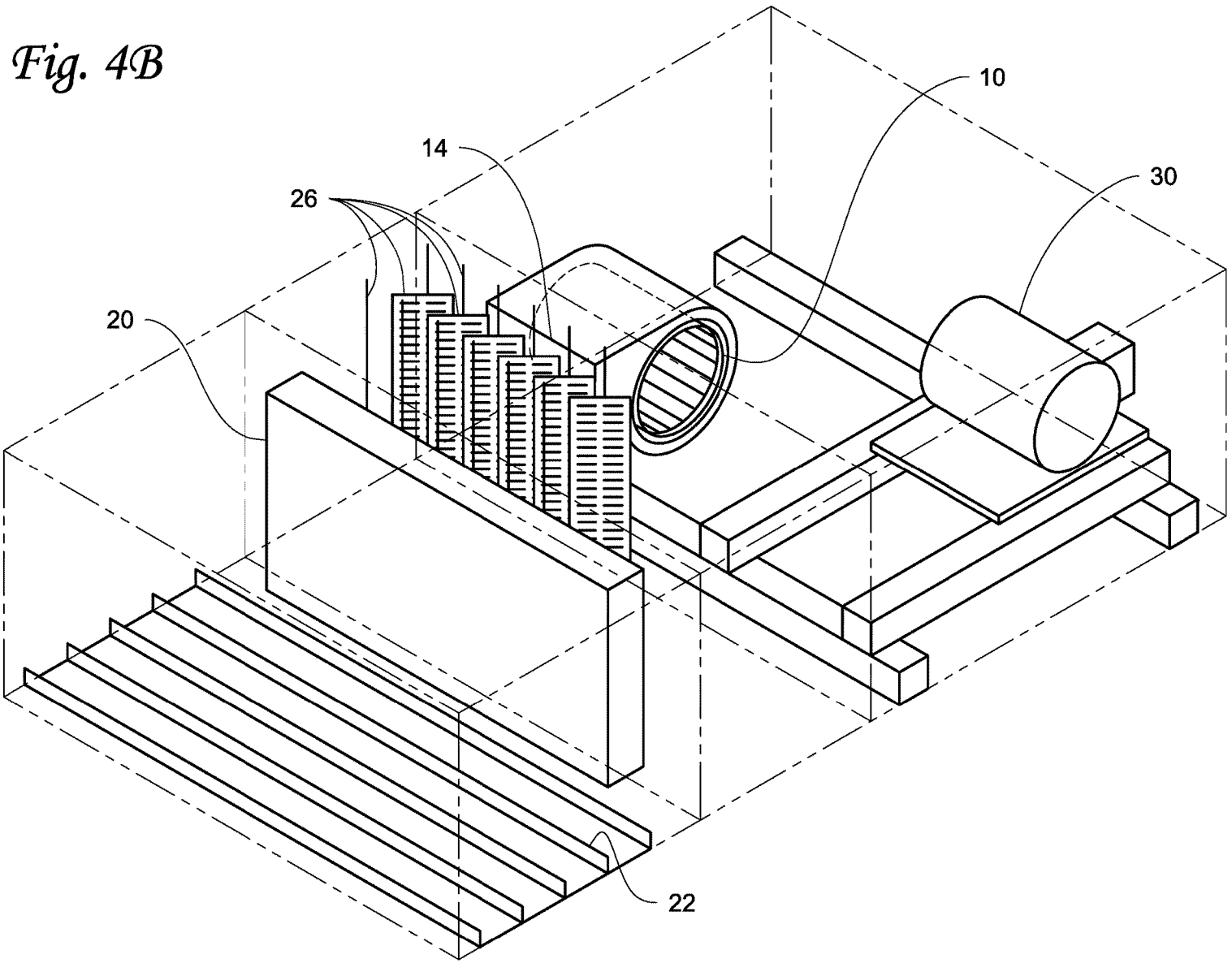
FIG. 4B shows a schematic of the HVACR air handling unit embodiment of FIG. 4A from an isometric view.

FIG. 4B shows a schematic of the embodiment of FIG. 4A from an isometric view. The planar diffuser elements 26 may extend from a floor of the air handling unit to a ceiling of the air handling unit. The diffuser elements 26 may be fixed to each of the floor and ceiling of the air handling unit. Drain pans 22 allow moisture carried off of the refrigeration coil 20 by the airflow to be captured and routed away from the rest of the HVACR system such as a supply outlet of the air handling unit.

Figure 5A:
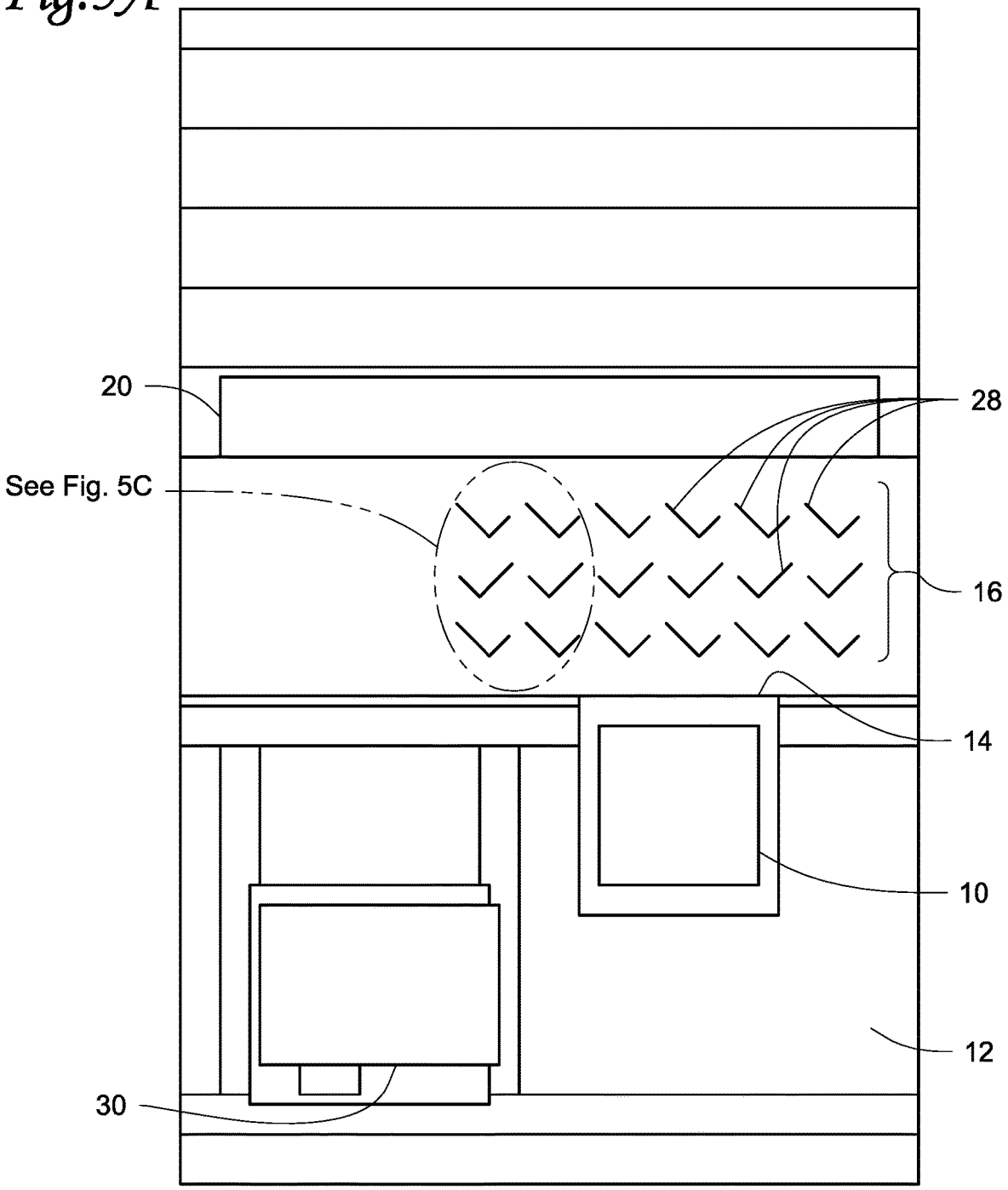
FIG. 5A shows a schematic of an HVACR air handling unit embodiment from a top-down view.

FIG. 5A shows a schematic of an embodiment from a top-down view. In the embodiment shown in FIG. 5A, diffuser elements 28 are L-shaped brackets. The L-shaped brackets, when viewed from the top-down or the bottom-up, have a bend forming an angle, for example at or about a 90-degree bend which creates a point or a curve in the L-shaped bracket. The L-shaped bracket diffuser elements 28 may be placed such that the portions of the L-shaped bracket on either side of the bend form angles between parallel and perpendicular to the airflow leaving the outlet 14 of the blower 10. In an embodiment, the L-shaped bracket diffuser elements 28 are at an angle to the airflow selected based on the flow distribution resulting from that angle of the planar diffuser elements 26. The angle between each portion of the L-shaped bracket diffuser elements 28 and the airflow leaving the outlet 14 of the blower 10 may be selected so that it is in a range which is neither too obtuse nor too acute to allow effective flow distribution. In an embodiment, each portion of the L-shaped bracket diffuser element forms an angle of at or about 45 degrees with the direction of the airflow leaving outlet 14 of blower 10. The point or the curve of the L-shaped bracket may be oriented such that it faces outlet 14 of blower 10, or faces opposite the direction of airflow leaving outlet 14 of blower 10. Each of the L-shaped brackets may have one portion that extends further from the bend than the other portion. The shorter portion of the bracket provides improved structural stability to the L-shaped bracket diffuser elements 28. In the embodiment shown in FIG. 5A, where each of the L-shaped brackets has one portion that extends further from the bend than the other portion. In an embodiment, the diffuser elements are perforated, with one or more holes through each of the diffuser elements 28. The size and/or shape of the perforations may be based on the effects of the diffuser on the velocity, volume, and/or pressure of airflow through the air handling unit and the velocity, volume, and/or pressure required to meet the HVACR needs of a structure receiving conditioned air. The perforations may be located on either or both portions of the L-shaped bracket extending from the bend.

The diffuser elements 28 may be arranged as a grid of rows and columns. In the embodiment shown in FIG. 5A, there are three rows perpendicular to the direction of airflow from the outlet 14 of blower 10, and six columns which are parallel with the direction of airflow from the outlet 14 of blower 10. The columns and rows may be aligned with one another to form a grid. In an embodiment, rows may alternate with regards to the side on which a portion of the bracket extends further.

Figure 5C:
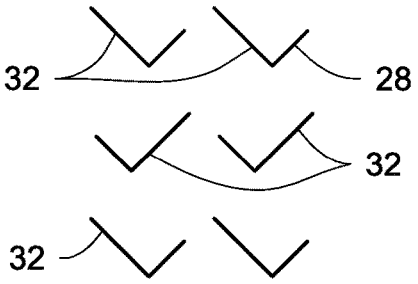
FIG. 5C shows an enlarged view of a portion of the top-down view of the air handling unit embodiment of FIG. 5*a*

FIG. 5C shows a close-up of the view of diffuser elements 28 in FIG. 5A. The diffuser elements 28 may be arranged such that the side of the diffuser element 28 having the longer portion 32 of the L-shaped bracket with respect to the direction of the airflow alternates with each row of diffuser elements. The diffuser elements 28 may be arranged such that the point where the L-shaped bracket bends is towards the blower, with each side of the L-shaped bracket extending diagonally away from the outlet 14 of the blower when viewed from the top down.

Figure 5B:
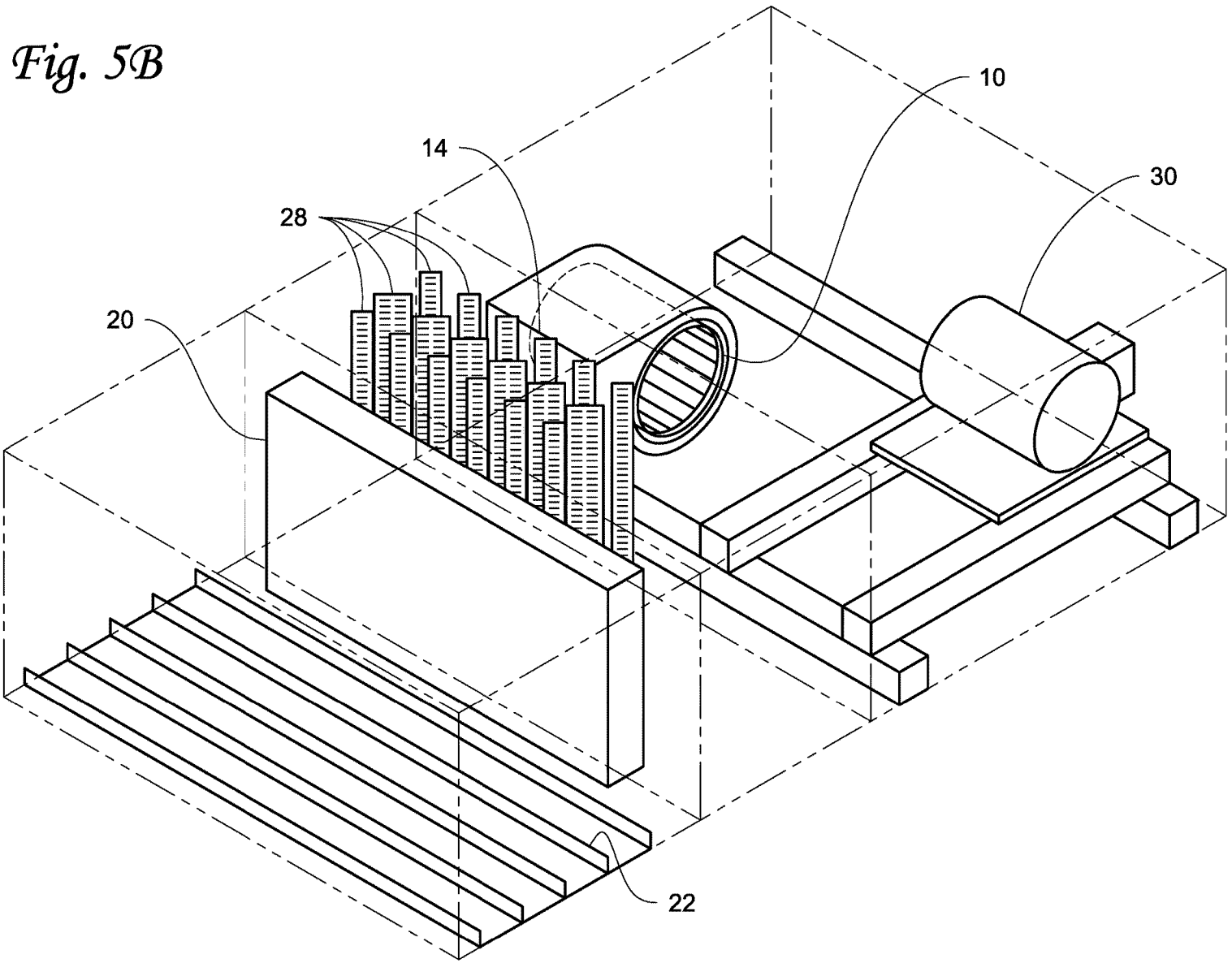
FIG. 5B shows a schematic of the HVACR air handling unit embodiment of FIG. 5A from an isometric view.

FIG. 5B shows a schematic of the embodiment of FIG. 5A from an isometric view. The diffuser elements 28 may extend from a floor of the air handling unit to a ceiling of the air handling unit. The diffuser elements 28 may be fixed to each of the floor and ceiling of the air handling unit. Drain pans 22 allow moisture carried off of the refrigeration coil 20 by the airflow to be captured and routed away from the rest of the HVACR system such as a supply outlet of the air handling unit.

Figure 6:
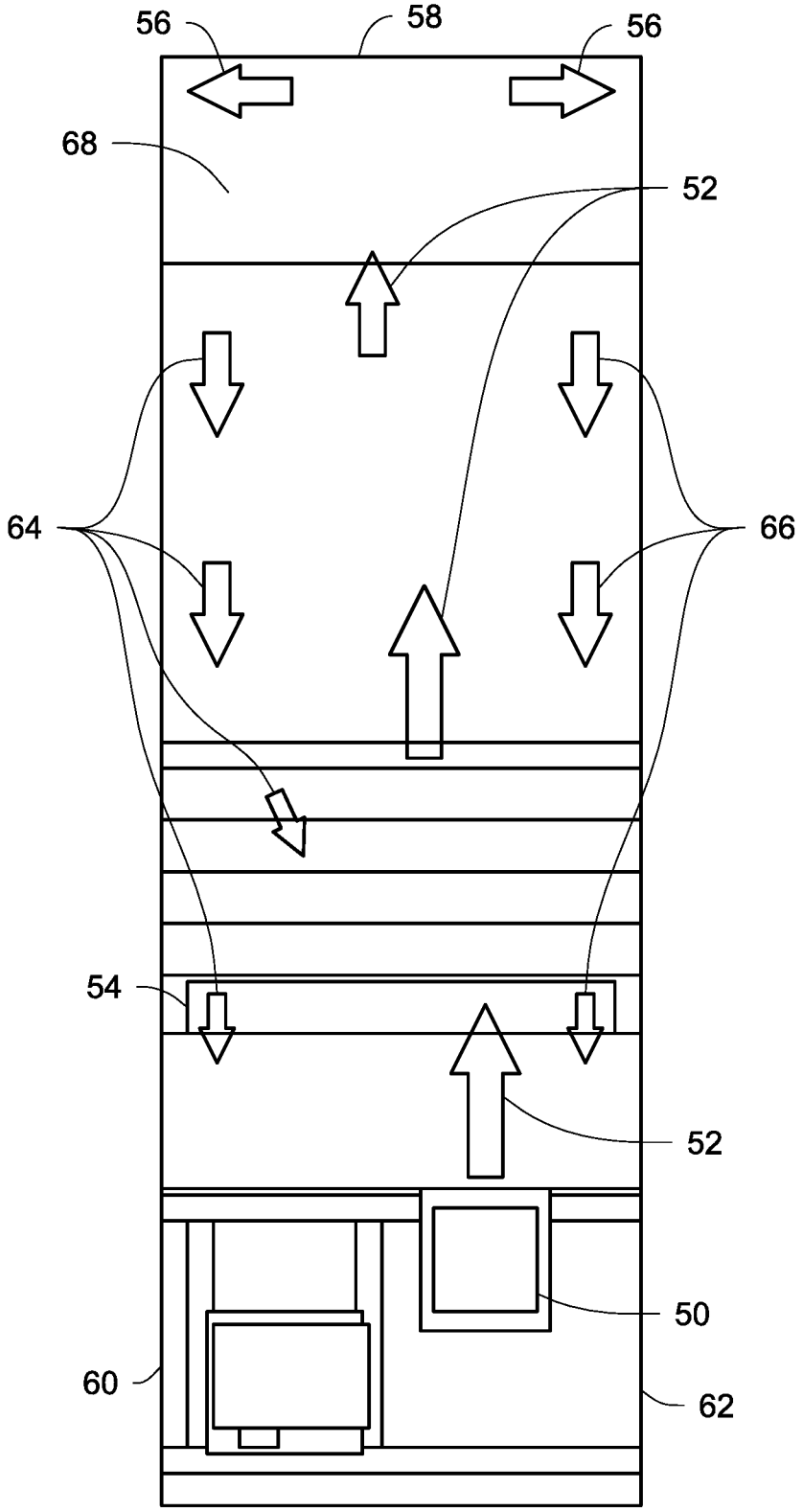
Fig. 6 (Prior Art)
FIG. 6 shows airflow through a prior art air handling unit.

FIG. 6 shows airflow in a prior art embodiment of an air handling unit. Blower 50 drives airflow 52 directly through refrigeration coil 54. The small size of the outlet of blower 50 compared to the size of refrigeration coil 54 and the velocity required for the volume of airflow 52 to meet building HVACR demands results in a high velocity flow through only a small portion of the refrigeration coil 54. A portion of airflow 56 travels through supply outlet 68, which directs the air into a building receiving conditioned air from an HVACR system including the air handling unit. A portion of airflow 56 circulates along the back wall 58 and becomes airflows 64 and 66 along the side walls 60 and 62 of the air handling unit, with some of airflows 64 and 66 travelling back through the refrigeration coil 68 in the reverse direction.

Figure 7:
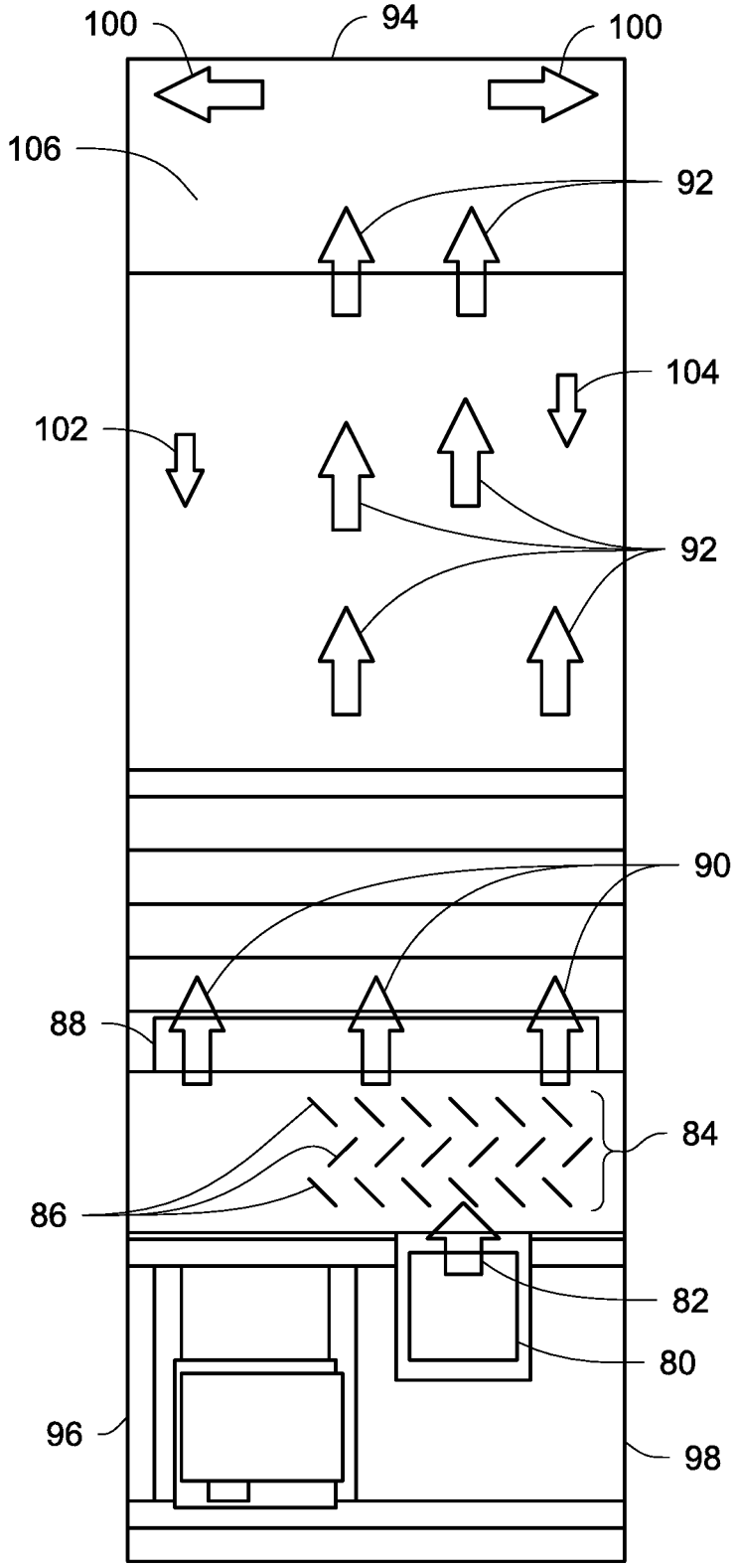
FIG. 7 shows airflow through an air handling unit embodiment.

FIG. 7 shows airflow in an air handling unit embodiment wherein the diffuser elements are generally planar plates. The blower 80 drives airflow 82 into diffuser 84. In the embodiment shown in FIG. 7, the diffuser 84 is composed of generally planar diffuser elements 86 organized in three rows, with each row alternating the angle between the diffuser elements 86 and the direction of the airflow 82 as it leaves the blower 80. Airflow 82 passes through diffuser 84. Deflection of airflow 82 by diffuser 84 causes the airflow 82 to spread out and slow down, resulting in airflow 90 exiting the diffuser and continuing on to the refrigeration coil 88. Airflow 90 is cooled by transferring heat to the refrigeration coil 88 as the airflow 90 passes through. After passing through the refrigeration coil 88 where the air is cooled, airflow 90 becomes airflow 92 which passes travels further through the air handling unit towards back wall 94. A portion of airflow 92 travels through supply outlet 106 into a building receiving air from an HVACR system including the air handling unit. A portion of airflow 92 becomes airflow 100 spreading against back wall 94 and dividing into airflows 102 and 104. Airflows 102 and 104 travel along the side walls 96 and 98, respectively. Airflows 102 and 104 may be smaller in volume and/or velocity than airflows 64 and 66 in the prior art embodiment shown in FIG. 6. In an embodiment, airflows 102 and 104 do not reach the refrigeration coil 88.

Figure 8:
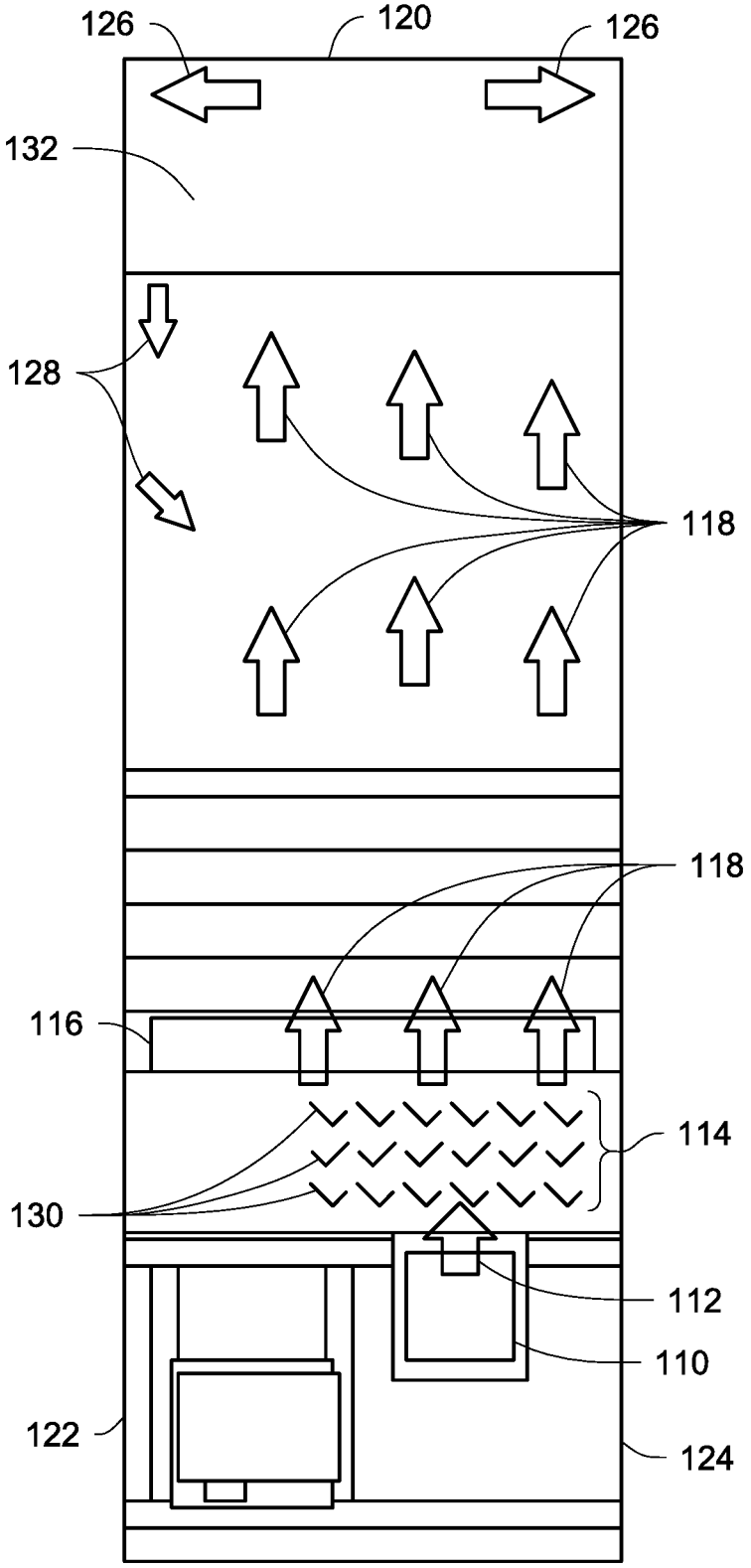
FIG. 8 shows airflow through an air handling unit embodiment.

FIG. 8 shows airflow in an air handling unit embodiment wherein the diffuser elements are L-shaped brackets. The blower 110 drives airflow 112 into diffuser 114. In the embodiment shown in FIG. 8, the diffuser 114 is composed of perforated L-shaped bracket diffuser elements 130 organized in three rows, with each row alternating the position of the longer side of the L-shape of the bracket with respect to the direction of the airflow 112 as it leaves the blower 110. Airflow 112 enters diffuser 114 and is deflected by the diffuser elements 130. This causes airflow 112 to spread out and slow down before it passes through the refrigeration coil 116, becoming airflow 118. Airflow 118 is cooled by transferring heat from the airflow 118 to the refrigeration coil 116. After airflow 118 is cooled by passing through the refrigeration coil 116, airflow 118 travels further through the air handling unit towards back wall 120. At least a portion of airflow 118 travels into the building receiving air from an HVACR system including the air handling unit through supply outlet 132. At back wall 120, a portion of airflow 126 becomes airflow 128, traveling along side wall 122 of the air handling unit before rejoining airflow 118. In an embodiment, airflow 128 does not reach the refrigeration coil 116.

Aspects:

It is appreciated that any of aspects 1-9 can be combined with any of aspects 10-20.

Aspect 1. An HVACR system, comprising:

an air handling unit comprising a blower driving an airflow, a refrigerant coil, located downstream of the blower with respect to the airflow, and a plurality of diffuser elements disposed between the blower and the refrigerant coil with respect to the airflow.

Aspect 2. The HVACR system according to aspect 1, wherein at least one diffuser element in the plurality of diffuser elements is cylindrical in shape.

Aspect 3. The HVACR system according to any of aspects 1-2, wherein at least one diffuser element in the plurality of diffuser elements is generally planar in shape.

Aspect 4. The HVACR system according to any of aspects 1-3, wherein at least one diffuser element in the plurality of diffuser elements is an L-shaped bracket.

Aspect 5. The HVACR system according to any of aspects 1-4, wherein at least one diffuser element in the plurality of diffuser elements is semi-circular in shape.

Aspect 6. The HVACR system according to any of aspects 1-5, wherein at least one diffuser element in the plurality of diffuser elements is perforated.

Aspect 7. The HVACR system according to any of aspects 1-6, wherein the plurality of diffuser elements are arranged into a chevron pattern.

Aspect 8. The HVACR system according to any of aspects 1-7, wherein the plurality of diffuser elements are arranged in a grid.

Aspect 9. The HVACR system according to any of aspects 1-8, wherein the plurality of diffuser elements are arranged in at least three staggered rows of diffuser elements.

Aspect 10. A method for directing an airflow through an HVACR system, comprising:

driving the airflow using a blower, deflecting the airflow via a diffuser comprising a plurality of diffuser elements, and cooling the airflow via a refrigerant coil after the airflow has been deflected by the diffuser.

Aspect 11. The method according to aspect 10, further comprising directing the airflow into a building to be cooled.

Aspect 12. The method according to any of aspects 10-11, wherein the airflow passes through the refrigerant coil in only one direction.

Aspect 13. The method according to any of aspects 10-12, wherein at least one diffuser element in the plurality of diffuser elements is cylindrical in shape.

Aspect 14. The method according to any of aspects 10-13, wherein at least one diffuser element in the plurality of diffuser elements is generally planar in shape.

Aspect 15. The method according to any of aspects 10-14, wherein at least one diffuser element in the plurality of diffuser elements is an L-shaped bracket.

Aspect 16. The method according to any of aspects 10-15, wherein at least one diffuser element in the plurality of diffuser elements is semi-circular in shape.

Aspect 17. The method according to any of aspects 10-16, wherein at least one diffuser element in the plurality of diffuser elements is perforated.

Aspect 18. The method according to any of aspects 10-17, wherein the plurality of diffuser elements are arranged into a chevron pattern.

Aspect 19. The method according to any of aspects 10-18, wherein the plurality of diffuser elements are arranged in a grid.

Aspect 20. The method according to any of aspects 10-19, wherein the plurality of diffuser elements are arranged in at least three staggered rows of diffuser elements.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A heating, ventilation, air conditioning and refrigeration (HVACR) system, comprising:

an air handling unit comprising a blower driving an airflow, a refrigerant coil, located downstream of the blower with respect to the airflow, and a plurality of diffuser elements disposed between the blower and the refrigerant coil with respect to the airflow, wherein the plurality of diffuser elements are arranged in at least two rows of diffuser elements, and, with respect to the refrigerant coil, each row of the at least two rows of diffuser elements is spaced apart from other rows of the at least two rows of diffuser elements.

2. The HVACR system of claim 1, wherein at least one diffuser element in the plurality of diffuser elements is cylindrical in shape.

3. The HVACR system of claim 1, wherein at least one diffuser element in the plurality of diffuser elements is generally planar in shape.

4. The HVACR system of claim 1, wherein at least one diffuser element in the plurality of diffuser elements is an L-shaped bracket.

5. The HVACR system of claim 1, wherein at least one diffuser element in the plurality of diffuser elements is semi-circular in shape.

6. The HVACR system of claim 1, wherein at least one diffuser element in the plurality of diffuser elements is perforated.

7. The HVACR system of claim 1, wherein the plurality of diffuser elements are arranged into a chevron pattern.

8. The HVACR system of claim 1, wherein the plurality of diffuser elements are arranged in a grid.

9. The HVACR system of claim 1, wherein the plurality of diffuser elements are arranged in at least three staggered rows of diffuser elements.

10. A method for directing an airflow through an air handler of a heating, ventilation, air conditioning, and refrigeration (HVACR) system, comprising:

driving the airflow using a blower, deflecting the airflow via a diffuser comprising a plurality of diffuser elements, and cooling the airflow via a refrigerant coil after the airflow has been deflected by the diffuser, wherein the plurality of diffuser elements are arranged in at least two rows of diffuser elements, and, with respect to the refrigerant coil, each row of the at least two rows of diffuser elements is spaced apart from other rows of the at least two rows of diffuser elements.

11. The method of claim 10, further comprising directing the airflow through a supply outlet.

12. The method of claim 10, wherein the airflow passes through the refrigerant coil in only one direction.

13. The method of claim 10, wherein at least one diffuser element in the plurality of diffuser elements is cylindrical in shape.

14. The method of claim 10, wherein at least one diffuser element in the plurality of diffuser elements is generally planar in shape.

15. The method of claim 10, wherein at least one diffuser element in the plurality of diffuser elements is an L-shaped bracket.

16. The method of claim 10, wherein at least one diffuser element in the plurality of diffuser elements is semi-circular in shape.

17. The method of claim 10, wherein at least one diffuser element in the plurality of diffuser elements is perforated.

18. The method of claim 10, wherein the plurality of diffuser elements are arranged into a chevron pattern.

19. The method of claim 10, wherein the plurality of diffuser elements are arranged in a grid.

20. The method of claim 10, wherein the plurality of diffuser elements are arranged in at least three staggered rows of diffuser elements.

* * * * *